United States Patent [19]

Sato et al.

[11] Patent Number: 4,758,503

[45] **Date of Patent: * Jul. 19, 1988**

[54] HEAT DEVELOPABLE LIGHT-SENSITIVE MATERIAL

[75] Inventors: Kozo Sato; Hiroyuki Hirai, both of Kanagawa, Japan

[73] Assignee: Fuji Photo Film Co., Ltd., Kanagawa, Japan

[ * ] Notice: The portion of the term of this patent subsequent to Dec. 30, 2003 has been disclaimed.

[21] Appl. No.: 844,423

[22] Filed: Mar. 26, 1986

[30] Foreign Application Priority Data

Mar. 26, 1985 [JP] Japan ..... 60-63084

[51] Int. Cl.[4] ..... G03C 5/54; G03C 7/26; G03C 7/32; G03C 1/06

[52] U.S. Cl. ..... 430/543; 430/203; 430/495; 430/559; 430/617; 430/619; 430/955

[58] Field of Search ..... 430/203, 151, 617, 619, 430/955, 559, 495, 543

[56] References Cited

U.S. PATENT DOCUMENTS

| | | | |
|---|---|---|---|
| 3,220,846 | 11/1965 | Tinker et al. | 430/617 |
| 4,603,103 | 7/1986 | Hirai et al. | 430/617 |
| 4,622,289 | 11/1986 | Hirai et al. | 430/203 |
| 4,626,500 | 12/1986 | Sato et al. | 430/203 |
| 4,636,462 | 1/1987 | Kawata et al. | 430/203 |
| 4,639,418 | 1/1987 | Yabuki et al. | 430/203 |
| 4,640,891 | 2/1987 | Yabuki et al. | 430/617 |

*Primary Examiner*—Richard L. Schilling

*Attorney, Agent, or Firm*—Sughrue, Mion, Zinn, Macpeak, and Seas

[57] ABSTRACT

A heat developable light-sensitive material containing a compound represented by the following general formula (I):

(I)

wherein $R_1$ and $R_2$, which may be the same or different, each represents a hydrogen atom, an alkyl group, a substituted alkyl group, a cycloalkyl group, an aralkyl group, a substituted aralkyl group, an aryl group, a substituted aryl group or a heterocyclic group, or $R_1$ and $R_2$ are bonded to each other to form a 5-membered or 6-membered carbocyclic ring or a heterocyclic ring which may be a saturated ring, an unsaturated ring or an aromatic ring, may be condensed and may further have one or more substituents; M represents an alkali metal ion, an alkaline earth metal ion, a transition metal ion, a protonated organic base or a quaternary ammonium ion; and n represents a reciprocal of the positive charge number of M. The heat developable light-sensitive material containing a base precursor represented by the general formula (I) has excellent stability during preservation and provides a color image having a high color density and low fog in a short time.

17 Claims, No Drawings

HEAT DEVELOPABLE LIGHT-SENSITIVE MATERIAL

FIELD OF THE INVENTION

The present invention relates to a heat developable light-sensitive material containing a base precursor.

BACKGROUND OF THE INVENTION

Bases or base precursors are frequently incorporated into heat developable light-sensitive materials for the purpose of accelerating development upon heating. In view of preservability of the light-sensitive materials, it is preferred to employ base precursors which release basic substances upon heat decomposition.

Examples of typical base precursors are described in British Pat. No. 998,949. A preferred base precursor is a salt of a carboxylic acid and an organic base, and examples of the suitable carboxylic acids include trichloroacetic acid and trifluoroacetic acid and examples of the suitable bases include guanidine, piperidine, morpholine, p-toluidine and 2-picoline, etc.

Guanidine trichloroacetate as described in U.S. Pat. No. 3,220,846 is particularly preferred. Further, aldonic amides as described in Japanese patent application (OPI) No. 22625/75 (the term "OPI" as used herein refers to a "published unexamined Japanese patent application") are preferably used because they decompose at a high temperature to form bases.

When these heretofore known base precursors are employed, however, the following problems are often encountered. Specifically, a relatively long time is required for obtaining images and a high level of fog is formed. Further, they have a disadvantage in that they are susceptive to air and humidity and decompose. As a result, the photographic properties of the light-sensitive materials containing them undergo a change and the preservability of the light-sensitive materials is seriously degraded.

SUMMARY OF THE INVENTION

Therefore, an object of the present invention is to provide a heat developable light-sensitive material containing a base precursor, which can form an image having a high density in a short time and have good preservability.

This and other objects of the present invention will become more apparent from the following detailed description and examples.

The objects of the present invention are met by a heat developable light-sensitive material containing a compound represented by the following general formula (I):

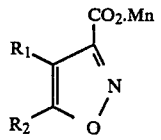

(I)

wherein $R_1$ and $R_2$, which may be the same or different, each represents a hydrogen atom, an alkyl group, a substituted alkyl group, a cycloalkyl group, an aralkyl group, a substituted aralkyl group, an aryl group, a substituted aryl group or a heterocyclic group, or $R_1$ and $R_2$ are bonded to each other to form a 5-membered or 6-membered carbocyclic ring or heterocyclic ring which may be a saturated ring, an unsaturated ring or an aromatic ring, may be condensed and may further have one or more substituents; M represents an alkali metal ion, an alkaline earth metal ion, a transition metal ion, a protonated organic base or a quaternary ammonium ion; and n represents a reciprocal of the positive charge number of M.

DETAILED DESCRIPTION OF THE INVENTION

The base precursor represented by the general formula (I) according to the present invention is described in detail in the following.

For $R_1$ or $R_2$, a hydrogen atom, a substituted or unsubstituted alkyl group having from 1 to 8 carbon atoms, for example, a methyl group, an isopropyl group, a tert-butyl group, etc., a cycloalkyl group having from 3 to 10 carbon atoms, for example, a cyclopentyl group, a cyclohexyl group, etc., a substituted or unsubstituted aryl group having from 6 to 10 carbon atoms, for example, a phenyl group, a p-chlorophenyl group, a p-methoxyphenyl group, etc., and a substituted or unsubstituted aralkyl group having from 7 to 12 carbon atoms, for example, a benzyl group, a $\beta$-phenethyl group, an $\alpha$-methylbenzyl group, etc. are preferred.

Further, preferred examples of the rings formed by bonding $R_1$ and $R_2$ include the following rings.

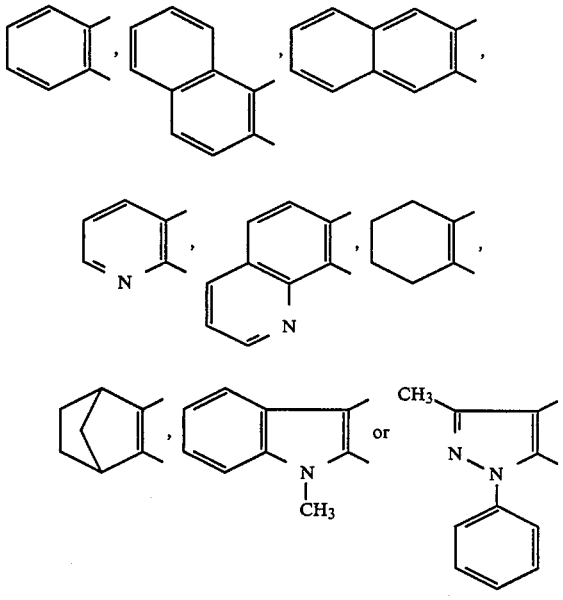

The above described ring may be further substituted with one or more substituents. Preferred examples of the substituents include an alkyl group, an alkoxy group, a halogen atom, a dialkylamino group, a hydroxy group, a carboxy group (including a salt thereof), an aryloxy group, a nitro group, a cyano group, a sulfamoyl group, a carbamoyl group, an acyl group, an acylamino group, an acyloxy group, an alkoxycarbonyl group, a sulfonylamino group, a ureido group, an alkylsulfonyl group, an arylsulfonyl group, an alkylthio group, an arylthio group, an aralkyl group, an aryl group, an alkenyl group, a cycloalkyl group, an amino group, etc.

For M, a metal ion, for example, ions of Na, K, Cs, Mg, Ca, Ba, Fe, Co, Ni, Cu, Ag, Hg, etc., a protonated organic base and a quaternary ammonium ion are preferred, particularly, the protonated organic base being preferably a protonated organic base having a pKa of 7 or more and 12 or less carbon atoms, and the quaternary ammonium ion being preferably a quaternary ammonium ion having 16 or less carbon atoms. Particularly preferred examples of M include quanidines, cyclic guanidines, amidines, an ammonium ion of cyclic amidines, a tetraalkyl ammonium ion, $Na^+$, $K^+$, $Cs^+$, $Ag^+$, etc.

n is 1 when M is a monovalent ion or n is a reciprocal of the positive charge number of M when M is a polyvalent ion.

Specific examples of the base precursors which can be preferably used in the present invention are set forth below, however, the present invention should not be construed as being limited thereto.

(1)

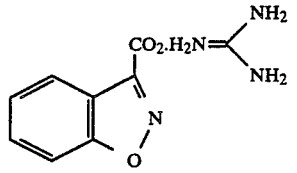

(2)

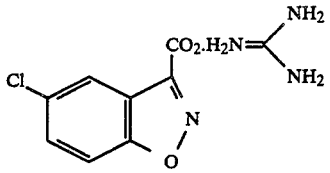

(3)

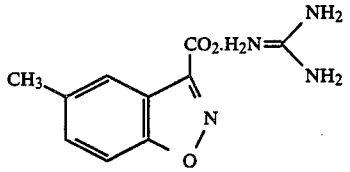

(4)

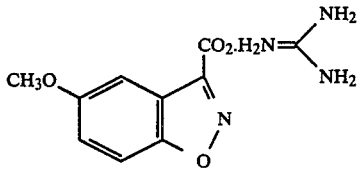

(5)

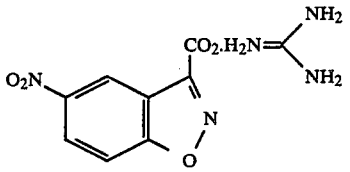

(6)

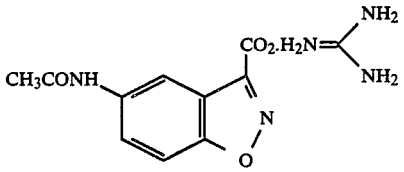

(7)

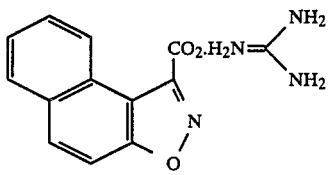

-continued (8)

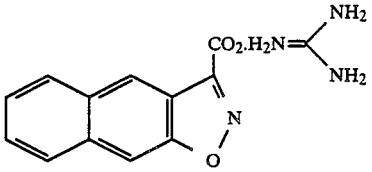

(9)

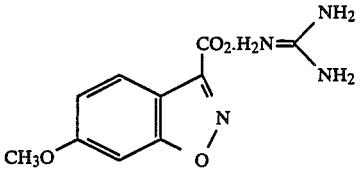

(10)

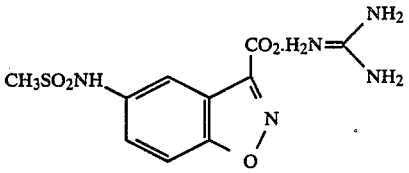

(11)

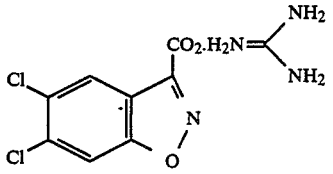

(12)

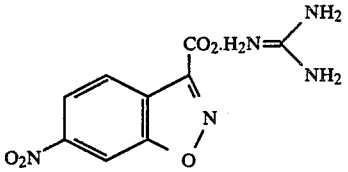

(13)

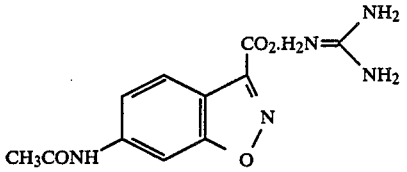

(14)

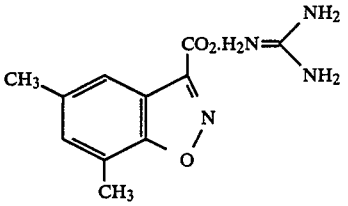

(15)

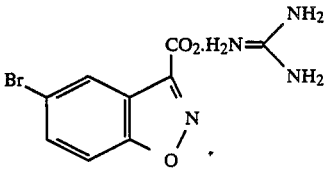

-continued
(16)
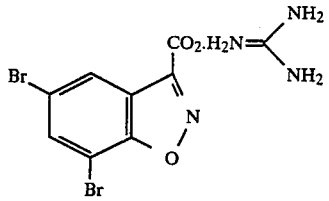
(17)
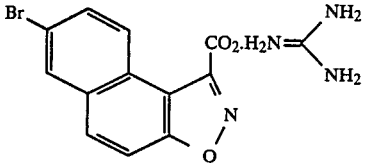
(18)
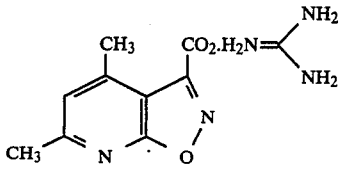
(19)
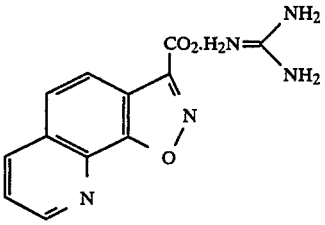
(20)
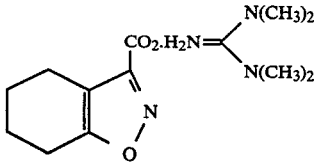
(21)
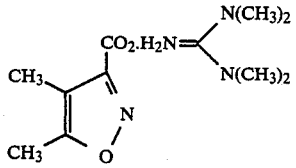
(22)
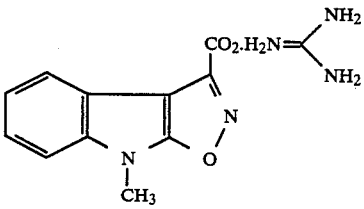
(23)
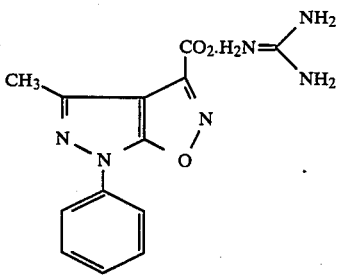
-continued
(24)
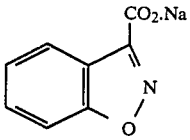
(25)
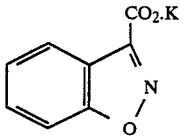
(26)
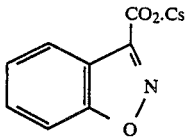
(27)
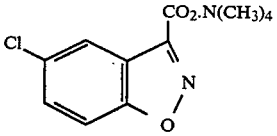
(28)
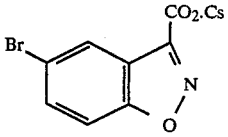
(29)
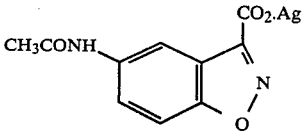
(30)
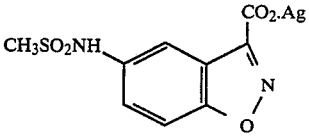
(31)
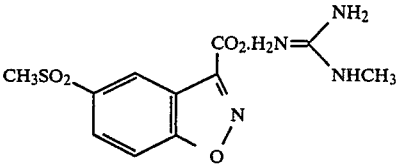
(32)
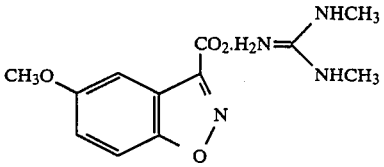
(33)
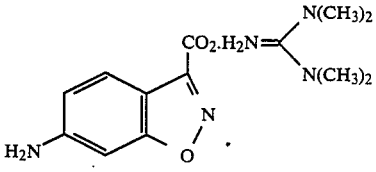

-continued (34)

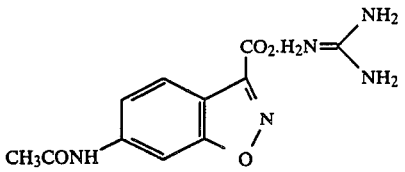

(35)

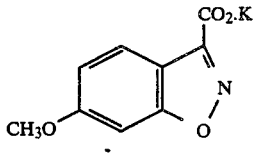

(36)

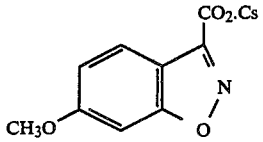

(37)

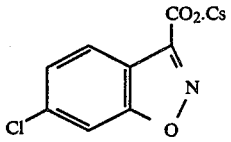

(38)

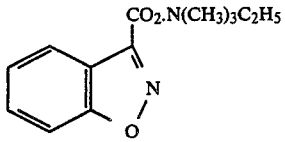

(39)

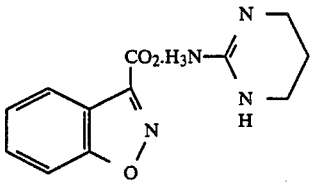

(40)

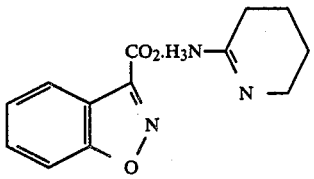

(41)

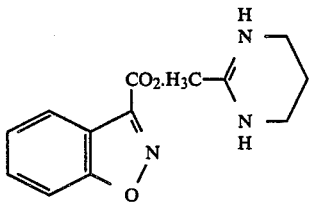

(42)

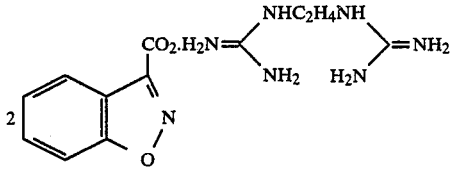

-continued (43)

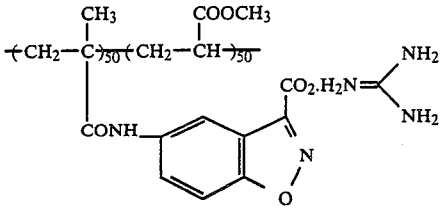

The base precursor according to the present invention can be synthesized using various methods, for example, as described in *J. Amer. Chem. Soc.*, 97, 7305 (1975). More specifically, the base precursor can be generally synthesized by, for example, a method using a reaction of a 2-hydroxyphenyl glyoxylic acid with a hydroxylamine-o-sulfonic acid, a method using an intramolecular ring closing reaction of an oxime of 2-nitrophenyl glyoxylic acid ester and hydrolysis, or a method using an electrophilic displacement reaction of the benzene ring in benzisoxazole-3-carboxylic acid, etc.

In the following, a method for synthesis of the base precursor according to the present invention is described with reference to the specific compound.

SYNTHESIS EXAMPLE

Synthesis of Base Precursor (1)

To a mixture of 150 g of ethyl o-nitrophenylacetate, 92.4 g of isoamyl nitrite and 1 liter of ethanol was added little by little 81 g of potassium tert-butoxide at 20° to 25° C. After the completion of the addition, the mixture was stirred at 50° to 55° C. for 2 hours. Then, the reaction mixture was cooled to room temperature, to which was added 320 ml of 3N hydrochloric acid and the crystals thus-deposited were collected by filtration. The crude product was recrystallized from diluted ethanol to obtain 102 g of the pure product having a melting point of 166° to 168° C.

30 g of the oxime obtained above was dissolved in 300 ml of dry diethylene glycol dimethyl ether and to the solution was added little by little 14.2 g of potassium tert-butoxide. tert-Butanol was distilled off with heating under a reduced pressure. Then, the mixture was gradually heated to 150° C. and stirred for 8 hours while heating at the same temperature. After allowing to cool, the reaction solution was poured into cold diluted hydrochloric acid and the brown precipitate thus-formed was collected by filtration and washed with water. The crude product was recrystallized from a solvent mixture of ethyl acetate and hexane to obtain 15.6 g of 3-ethoxycarbonylbenzisoxazole having a melting point of 56° to 58° C. as the pure product.

A mixture of 15 g of the ester obtained above and 300 ml of 70% sulfuric acid was heated at 80° C. for 4 hours with stirring. After allowing to cool, ice water was added to the reaction mixture and the mixture was stirred at 10° C. for 1 hour. The crystals thus-deposited were collected by filtration and washed with water. The crude product was recrystallized from a solvent mixture of ethyl acetate and hexane to obtain 11.5 g of benzisoxazole-3-carboxylic acid having a melting point of 145° to 146° C. as the pure product.

8.2 g of the benzisoxazole-3-carboxylic acid obtained above was dissolved in 50 ml of methanol and to the solution was added little by little a solution containing 4.5 g of guanidine carbonate dissolved in 30 ml of water.

After the completion of addition, the solvent was distilled off under a reduced pressure at 50° C. or below to obtain 11.0 g of Base Precursor (1) as white crystals. Melting Point: 123° to 124° C. (decomposed).

Synthesis of Base Precursor (2)

Base Precursor (2) was synthesized in the same manner as in Synthesis of Base Precursor (1) as described above except that ethyl-2-nitro-5-chlorophenyl acetate was used in place of ethyl-o-nitrophenyl acetate.

The base precursor according to the present invention exhibits particularly great effects, when it is employed together with a spectrally sensitized light-sensitive silver halide emulsion. More specifically, the degree of increase in image density is particularly great when it is used together with a spectrally sensitized light-sensitive silver halide emulsion.

The spectral sensitization of silver halide emulsions can be performed using methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, as a basic heterocyclic nucleus, it applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a napthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5-membered or 6-membered heterocyclic nuclei such as a pyrazolin-5-one nucleus, a thiohydantoin nucleus, a 2-thioxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combination thereof. A combination of sensitizing dyes is often used, particularly for the purpose of supersensitization.

Useful sensitizing dyes include those described in German Patent 929,080, U.S. Pat. Nos. 2,493,748, 2,503,776, 2,519,001, 2,912,329, 3,656,959, 3,672,897, 3,694,217, 4,025,349 and 4,046,572, British Patent 1,242,588, Japanese Patent Publication Nos. 14030/69 and 24844/77, etc.

A suitable amount of the sensitizing dye to be used is from 0.001 g to 20 g, and preferably from 0.01 g to 2 g, per 100 g of silver to be used for preparing an emulsion.

The base precursor according to the present invention can be used in an amount of a broad range. It is suitably used in an amount of 50% by weight or less, and more preferably in a range from 0.01% by weight to 40% by weight, based on the coated amount of a dry layer of the light-sensitive material.

Any unit and layer structure can be applied to the light-sensitive material of the present invention. The base precursor may be incorporated into any one of various layers of the light-sensitive material. When a light-sensitive emulsion layer and a layer containing a dye providing substance are separately constructed, the base precursor may be incorporated into any of these layers. Further, it can be incorporarted into an intermediate layer or a protective layer.

Moreover, two or more kinds of the base precursors can be used according to the present invention.

In the present invention, silver halide is employed as a light-sensitive substance.

The silver halide used in the present invention includes silver chloride, silver chlorobromide, silver chloroiodide, silver bromide, silver iodobromide, silver chloroiodobromide, silver iodide, etc.

A process for preparing these silver halides is explained taking the case of silver iodobromide. That is, the silver iodobromide is prepared by first adding a silver nitrate solution to a potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* the Fourth Edition, Chapter 6, pages 149 to 169.

A suitable coating amount of the light-sensitive silver halide in the present invention is in a range from 1 mg to 10 g per $m^2$ calculated as an amount of silver.

In particularly preferred embodiment of the heat developable light-sensitive material according to the present invention, an organic silver salt oxidizing agent is used together with silver halide. The organic silver salt oxidizing agent is a silver salt which forms a silver image by reacting with an image forming substance as described below or a reducing agent coexisting, if necessary, with the image forming substance, when it is heated to a temperature of above 80° C. and, preferably, above 100° C. in the presence of exposed silver halide. By coexisting the organic silver salt oxidizing agent, a light-sensitive material which provides higher color density can be obtained.

With respect to the silver halide used in this case, it is not necessary required to have such a characteristic that the silver halide contains pure silver iodide crystal in the case of using the silver halide alone. Any silver halide which is known in the art can be used.

Examples of such organic silver salt oxidizing agents include those described in Japanese Patent Application (OPI) No. 5843/83, and are specifically described in the following.

A silver salt of an organic compound having a carboxy group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75, 42529/76, 13224/74 and 17216/75, U.S. Pat. No. 3,700,458, etc.

A suitable coating amount of the lightsensitive silver halide and the organic silver salt oxidizing agent employed in the present invention is in a total of from 50 $mg/m^2$ to 10 $g/m^2$ calculated as an amount of silver.

In the present invention, a wide variety of image forming substances can be used in various manners in addition to the use of silver as an image forming substance.

For instance, couplers capable of forming color images by bonding to oxidation products of developing agents employed in liquid development processing, which have so far been widely known, with specific examples including magenta couplers such as 5-pyrazolone couplers, pyrazolobenzimidazole couplers, cyanoacetylcumarone couplers, open chain acylacetonitrile couplers and so on, yellow couplers such as acylacetamide couplers (e.g., benzoylacetanilides, pivaloylacetanilides, etc.), and cyan couplers such as naphthol couplers and phenol couplers, can be used.

It is generally desirable that these couplers should be rendered nondiffusible by containing a hydrophobic groups which is called as a ballast group in their molecules, or that the couplers should be polymeric couplers. The couplers may be either 4-equivalent or 2-equivalent with respect to silver ion. Further, these couplers may be colored couplers having a color correction effect, or couplers capable of releasing development inhibitors upon development (so-called DIR couplers).

In addition, dyes which can produce positive color images using light-sensitive silver dye bleach processes, for example, dyes as described in *Research Disclosure,* pages 30 to 32, RD-14433 (April, 1976); ibid., pages 14 and 15, RD-15227 (December, 1976), U.S. Pat. No. 4,235,957 and so on, and leuco dyes as described in U.S. Pat. Nos. 3,985,565 and 4,022,617, can be used.

Also, dyes into which nitrogen-containing heterocyclic groups are introduced as described in *Research Disclosure,* pages 54 to 58, RD-16966 (May, 1978) can be used.

Moreover, dye providing substances as described in European Pat. Nos. 67,455 and 79,056, West German Pat. No. 3,217,853, which release mobile dyes utilizing the coupling reaction with reducing agents oxidized by a redox reaction with silver halide or organic silver salt oxidizing agents under high temperatures, and dye providing substances as described in European Pat. Nos. 66,282 and 76,492, West German Pat. No. 3,215,485, and Japanese Patent Application (OPI) Nos. 152440/84 and 154445/84, which undergo a redox reaction with silver halide or organic silver salt oxidizing agents under high temperatures, and release mobile dyes as a result of this reaction, can be used.

Dye providing substances which can be used in the above described processes are preferably represented by the following formula (CI):

$$(\text{Dye}—X)_q—Y \qquad \text{(CI)}$$

wherein Dye represents a dye which becomes mobile when it is released from the molecule of the compound represented by the formula (CI); X represents a simple bond or a connecting group; q represents 1 or 2; and Y represents a group which releases Dye in corresponding or countercorresponding to light-sensitive silver salts having a latent image distributed imagewise, the diffusibility of the dye released being different from that of the compound represented by Dye-X-Y.

The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes and phthalocyanine dyes, etc. These dyes can also be used in the form of having temporarily shorter wavelengths, the color of which is recoverable in the development processing.

More specifically, the dyes as described in European Patent Application (OPI) No. 76,492 can be utilized.

Examples of the connecting group represented by X include —NR— (wherein R represents a hydrogen atom, an alkyl group, or a substituted alkyl group), $—SO_2—$, —CO—, an alkylene group, a substituted alkylene group, a phenylene group, a substituted phenylene group, a naphthylene group, a substituted naphthylene group, —O—, —SO—, or a group derived by combining together two or more of the foregoing groups.

In the following, preferred embodiments of Y in formula (CI) are described in greater detail.

In one embodiment, Y is selected so that the compound represented by the general formula (CI) is a nondiffusible image forming compound which is oxidized as a result of development, thereby undergoing selfcleavage and releasing a diffusible dye.

An Example of Y which is effective for compounds of this type is an N-substituted sulfamoyl group. For example, a group represented by formula (CII) is illustrated for Y.

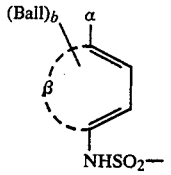

(CII)

wherein $\beta$ represents non-metallic atoms necessary for forming a benzene ring, which may optionally be condensed with a carbon ring or a hetero ring to form, for example, a naphthalene ring, a quinoline ring, a 5,6,7,8-tetrahydronaphthalene ring, a chroman ring or the like;

$\alpha$ represents a group of $—OG^{11}$ or $—NHG^{12}$ (wherein $G^{11}$ represents a hydrogen atom or a group which forms a hydroxyl group upon being hydrolyzed, and $G^{12}$ represents a hydrogen atom, an alkyl group containing from 1 to 22 carbon atoms or a hydrolyzable group);

Ball represents a ballast group; and b represents an integer of 0, 1 or 2.

Specific examples of this type of Y are described in Japanese Patent Application (OPI) Nos. 33826/73 and 50736/78.

Other examples of Y suited for this type of compound are those represented by the following general formula (CIII):

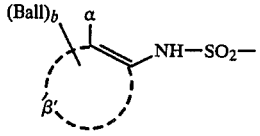

(CIII)

wherein Ball, $\alpha$ and b are the same as defined with (CII), $\beta'$ represents atoms necessary for forming a carbon ring (e.g., a benzene ring which may be fused with another carbon ring or a hetero ring to form a naphthalene ring, quinoline ring, 5,6,7,8-tetrahydronaphthalene ring, chroman ring or the like. Specific examples of this type of Y are described in Japanese Patent Application (OPI) Nos. 113624/76, 12642/81, 16130/81, 16131/81, 4043/82 and 650/82 and U.S. Pat. No. 4,053,312.

Further examples of Y suited for this type of compound are those represented by the following formula (CIV):

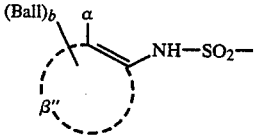

(CIV)

wherein Ball, $\alpha$ and b are the same as defined with the formula (CII), and $\beta''$ represents atoms necessary for forming a hetero ring such as a pyrazole ring, a pyridine ring or the like, said hetero ring being optionally bound to a carbon ring or a hetero ring. Specific examples of this type of Y are described in Japanese Patent Application (OPI) No. 104343/76.

Still further examples of Y suited for this type of compound are those represented by the following formula (CV):

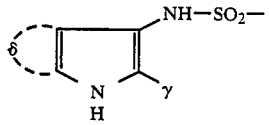

(CV)

wherein $\gamma$ preferably represents a hydrogen atom, a substituted or unsubstituted alkyl, aryl or heterocyclic group, or $—CO—G^{21}$; $G^{21}$ represents $—OG^{22}$, $—SG^{22}$ or

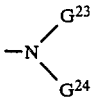

(wherein $G^{22}$ represents a hydrogen atom, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{24}$ represents a hydrogen atom or an unsubstituted or substituted alkyl group); and $\delta$ represents a residue necessary for completing a condensed benzene ring.

Specific examples of this type of Y are described in Japanese Patent Application (OPI) Nos. 104343/76, 46730/78, 130122/79 and 85055/82.

Still further examples of Y suited for this type of compound are those represented by the formula (CVI):

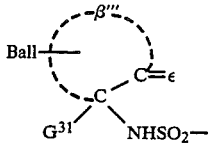

(CVI)

wherein Ball is the same as defined with the formula (CII); $\epsilon$ represents an oxygen atom or $=NG^{32}$ (wherein $G^{32}$ represents a hydroxy group or an optionally substituted amino group) (examples of $H_2N-G^{32}$ to be used for forming the group of $=NG^{32}$ including hydroxylamine, hydrazines, semicarbazides, thiosemicarbazides, etc.); $\beta'''$ represents a saturated or unsaturated nonaromatic 5-, 6- or 7-membered hydrocarbon ring; and $G^{31}$ represents a hydrogen atom or a halogen atom (e.g., a fluorine atom, a chlorine atom, a bromine atom, etc.).

Specific examples of this type of Y are described in Japanese Patent Application (OPI) Nos. 3819/78 and 48534/79.

Other examples of Y of this type of compound are described in Japanese Patent Publication Nos. 32129/73, 39165/73, Japanese Patent Application (OPI) No. 64436/74, U.S. Pat. No. 3,443,934, etc.

Still further examples of Y are those represented by the following formula (CVII):

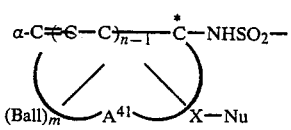

(CVII)

wherein $\alpha$ represents $—OR^{41}$ or $—NHR^{42}$; $R^{41}$ represents a hydrogen atom or a hydrolyzable component;

$R^{42}$ represents a hydrogen atom, an alkyl group containing from 1 to 50 carbon atoms or a hydrolyzable group; $A^{44}$ represents atoms necessary for forming an aromatic ring; Ball represents an organic immobile group existing on the aromatic ring, with Ball's being the same or different from each other; m represents an integer of 1 or 2; X represents a divalent organic group having from 1 to 8 atoms, with the nucleophilic group (Nu) and an electrophilic center (asterisked carbon atom) formed by oxidation forming a 5- to 12-membered ring; Nu represents a nucleophilic group; n represents an integer of 1 or 2; and $\alpha$ may be the same as defined with the above described formula (CII). Specific examples of this type of Y are described in Japanese Patent Application (OPI) No. 20735/82.

In another embodiment, Y is selected so that the compound represented by the general formula (CI) is a nondiffusible image forming compound which releases a diffusible dye in the presence of a base as a result of self cyclization or the like but which, when reacted with an oxidation product of a developing agent, substantially never releases the dye.

Examples of Y effective for this type of compound are those which are represented by the formula (CVIII):

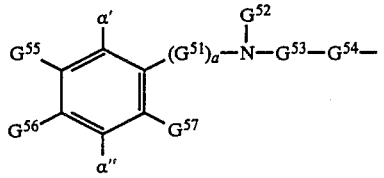

(CVIII)

wherein $\alpha'$ represents an oxidizable nucleophilic group (e.g., a hydroxy group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having from 1 to 3 carbon atoms;

a represents 0 or 1;

$G^{52}$ represents a substituted or unsubstituted alkyl group having from 1 to 40 carbon atoms or a substituted or unsubstituted aryl group having from 6 to 40 carbon atoms;

$G^{53}$ represents an electrophilic group such as —CO— or —CS—;

$G^{54}$ represents an oxygen atom, a sulfur atom, a selenium atom, a nitrogen atom or the like and, when $G^{54}$ represents a nitrogen atom, it has a hydrogen atom or may be substituted with an alkyl group or a substituted alkyl group having from 1 to 10 carbon atoms or an aromatic residue having from 6 to 20 carbon atoms; and $G^{55}$, $G^{56}$ and $G^{57}$ each represents a hydrogen atom, a halogen atom, a carbonyl group, a sulfamyl group, a sulfonamido group, an alkyloxy group having from 1 to 40 carbon atoms or an optional group defined for $G^{52}$, $G^{55}$ and $G^{56}$ may together form a 5- to 7-membered ring, and $G^{56}$ may represent

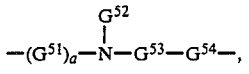

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by the following general formulae (CIX) and (CX):

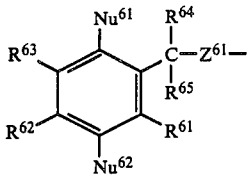

(CIX)

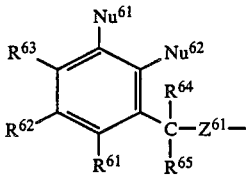

(CX)

wherein $Nu^{61}$ and $Nu^{62}$, which may be the same or different, each represents a nucleophilic group or a precursor thereof; $Z^{61}$ represents a divalent atomic group which is electrically negative with respect to the carbon atom substituted by $R^{64}$ and $R^{65}$; $R^{61}$, $R^{62}$ and $R^{63}$ each represents a hydrogen atom, a halogen atom, an alkyl group, an alkoxy group or an acylamino group or, when located at adjacent positions on the ring, $R^{61}$ and $R^{62}$ may form a condensed ring together with the rest of the molecule, or $R^{62}$ and $R^{63}$ may form a condensed ring together with the rest of the molecule; $R^{64}$ and $R^{65}$, which may be the same or different, each represents a hydrogen atom, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above described compounds immobile. Specific examples of this type of Y are described in Japanese Patent Application (OPI) Nos. 69033/78 and 130927/79.

Further examples of Y suited for this type of compound are those which are represented by the formula (CXI):

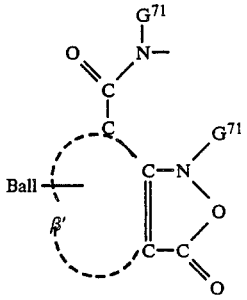

(CXI)

wherein Ball and $\beta'$ are the same as defined for those in the formula (CIII), and $G^{71}$' represents an alkyl group (including a substituted alkyl group). Specific examples of this type of Y are described in Japanese Patent Application (OPI) Nos. 111628/74 and 4819/77.

In still another embodiment, Y is selected so that the compound represented by the general formula (CI) is a nondiffusible image forming compound which itself does not release any dye but, upon reaction with a reducing agent, releases a dye. With these compounds, compounds which mediate the redox reaction (called electron donors) are preferably used in combination.

Examples of Y effective for this type of compound are those represented by the formula (CXII):

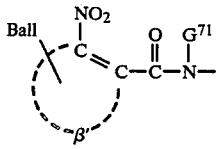

(CXII)

wherein Ball and $\beta'$ are the same as defined for those in the general formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by the formula (CXIII):

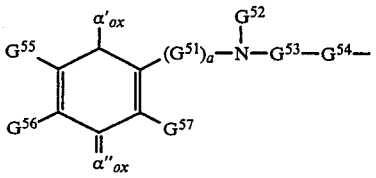

(CXIII)

wherein $\alpha'_{ox}$ and $\alpha''_{ox}$ represent groups capable of giving $\alpha'$ and $\alpha''$, respectively, upon reduction, and $\alpha'$, $\alpha''$, $G^{51}$, $G^{52}$, $G^{53}$, $G^{54}$, $G^{55}$, $G^{56}$, $G^{57}$ and a are the same as defined with respect to the formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by the formulae (CXIVA) and (CXIVB):

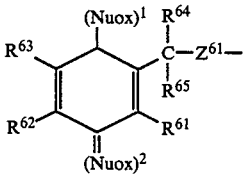

(CXIVA)

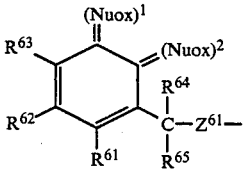

(CXIVB)

wherein $(Nuox)^1$ and $(Nuox)^2$, which may be the same or different, each represents an oxidized nucleophilic group, and other notations are the same as defined with respect to the formulae (CIX) and (CX). Specific examples of this type of Y are described in Japanese Patent Application (OPI) Nos. 1309227/79 and 164342/81.

The publicly known documents having been referred to with respect to (CXII), (CXIII), (CXIVA) and (CXIVB) describe electron donors to be used in combination.

In a further embodiment, Y is selected so that the compound represented by the general formula (CI) is an LDA compound (Linked Donor Acceptor Compounds). The compound is a nondiffusible image forming compound which causes donor acceptor reaction in the presence of a base to release a diffusible dye but, upon reaction with an oxidation product of a developing agent, it substantially does not release the dye any more.

Examples of Y effective for this type of compound are those represented by the formula (CXV) (specific examples thereof being described in Japanese Patent Application (OPI) No. 185333/84):

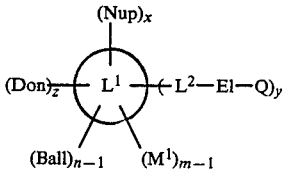

(CXV)

wherein n, x, y and z each represents 1 or 2, m represents an integer of 1 or more; Don represents a group containing an electron donor or its precursor moiety; $L^1$ represents an organic group linking Nup to —El—Q or Don; Nup represents a precursor of a nucleophilic group; El represents an electrophilic center; Q represents a divalent group; Ball represents a ballast group; $L^2$ represents a linking group; and $M^1$ represents an optional substituent.

The ballast group is an organic ballast group which can render the dye image forming compound nondiffusible, and is preferably a group containing a hydrophobic group having 8 to 12 carbon atoms. Such organic ballast group is bound to the dye image forming compound directly or through a linking group (e.g., an imino bond, an ether bond, a thioether bond, a carbon-amido bond, a sulfonamido bond, a ureido band, an ester bond, a carbamoyl bond, a sulfamoyl bond, etc., and combination thereof).

Two or more kinds of the dye providing substances can be employed together. In such a case two or more kinds of the dye providing substances may be used together in order to provide the same hue or in order to reproduce black color.

Specific examples of the image forming substances used in the present invention are described in the aforementioned patents. Since all suitable compounds cannot be illustrated herein, only some of them are set forth as examples. For example, as dye providing substances represented by the above described general formula (CI), there are the following.

CI-1
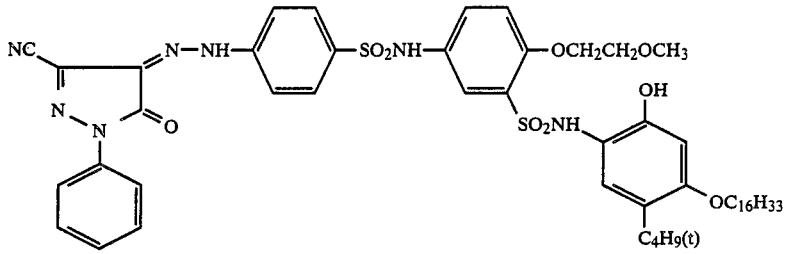
CI-2
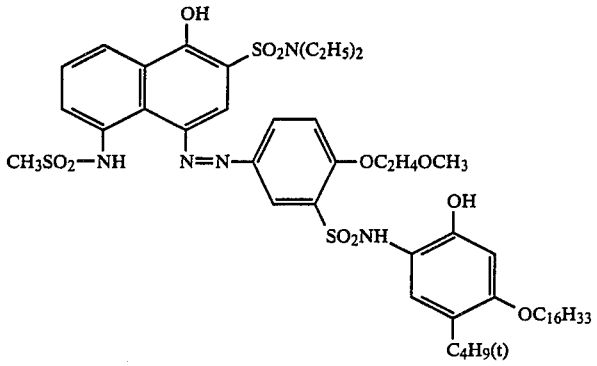
CI-3
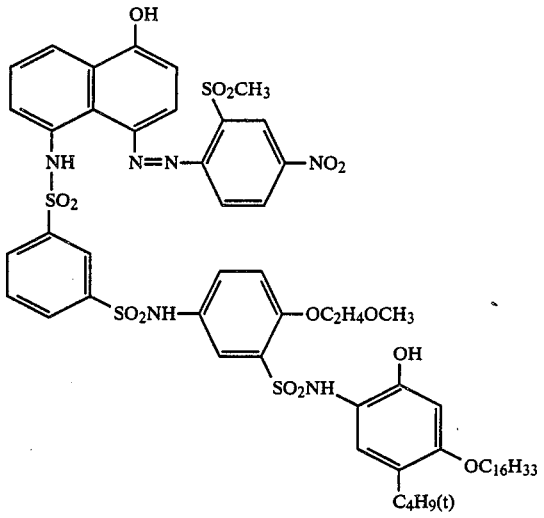
CI-4
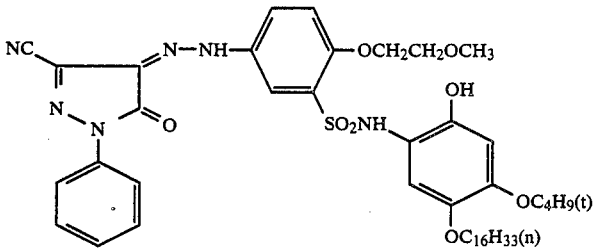

-continued
CI-5
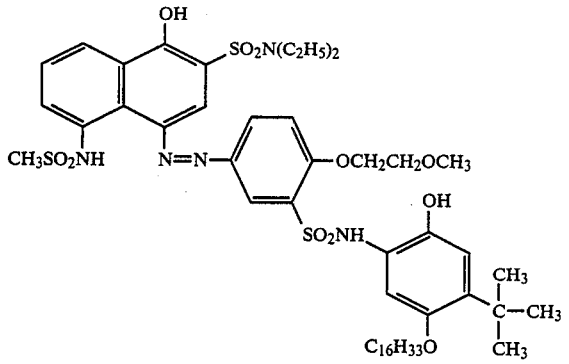
CI-6
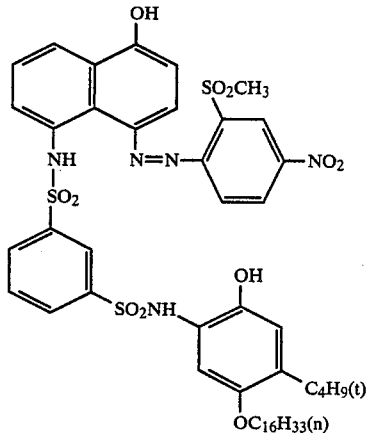
CI-7
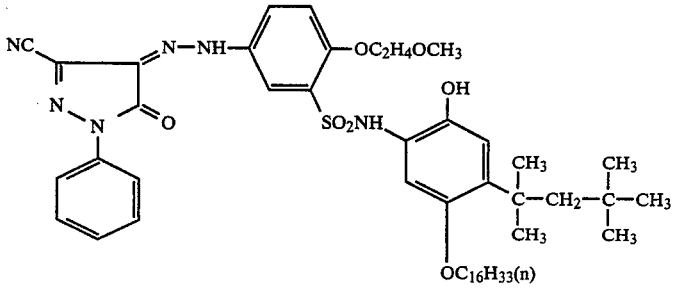
CI-8
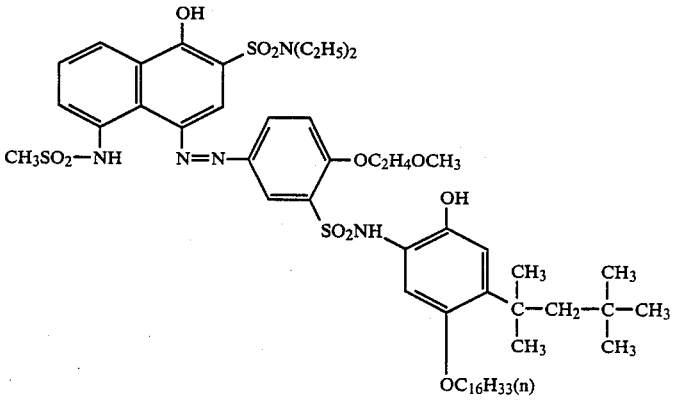

-continued
CI-9
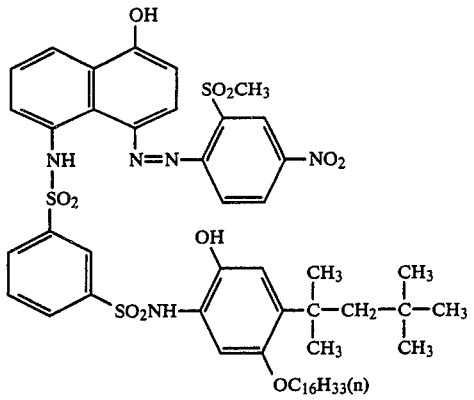
CI-10
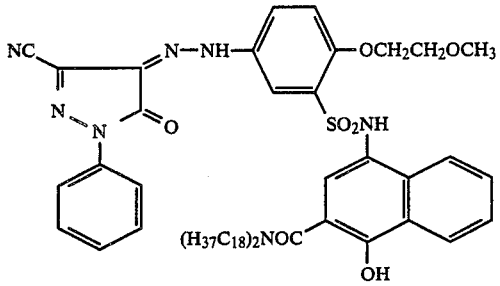
CI-11
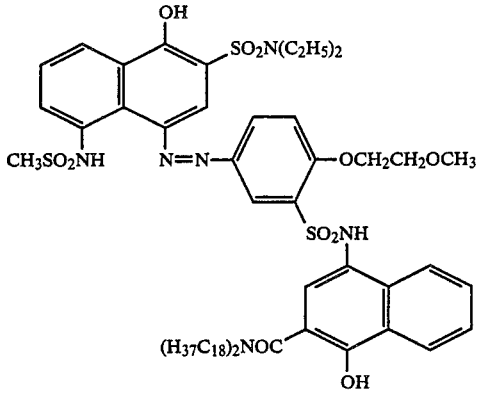
CI-12
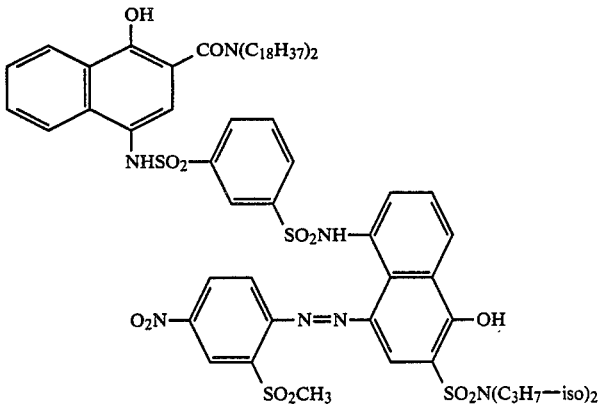

-continued
CI-13
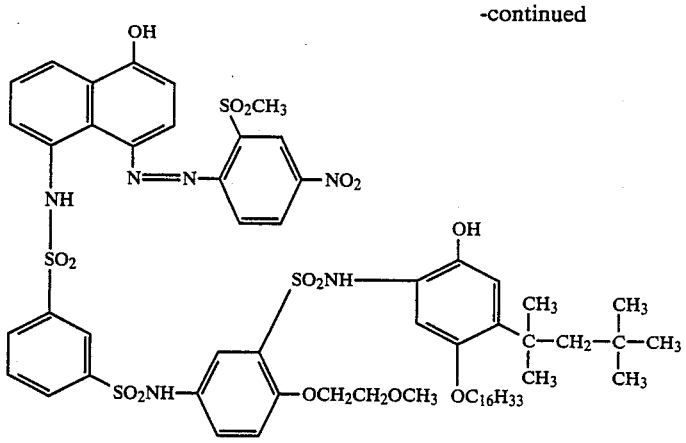
CI-14
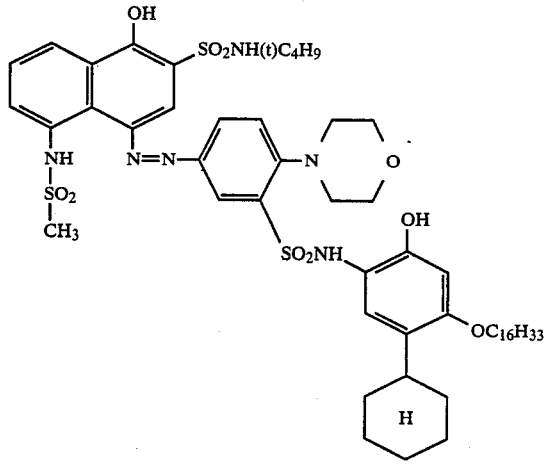
CI-15
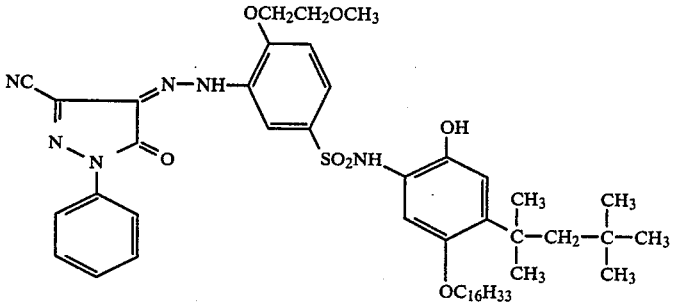
CI-16
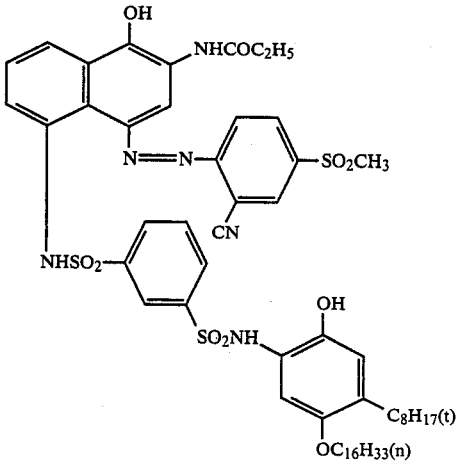

The above described compounds are merely examples, and the compounds which can be used in the present invention are not to be construed as being limited thereto.

Many of the above described substances form an imagewise distribution of mobile dyes corresponding to exposure in a light-sensitive material by heat development, and methods for transferring these image dyes into a dye fixing material (so-called diffusion transfer) to visualize the images are described in the above described patents and Japanese Patent Application (OPI) Nos. 168439/84, 182447/84, etc.

The dye providing substance used in the present invention can be introduced into a layer of the light-sensitive material by known methods such as the method as described in U.S. Pat. No. 2,322,027, etc. In such a case, an organic solvent having a high boiling point or an organic solvent having a low boiling point as described below can be used. For example, the dye providing substance is dispersed in a hydrophilic colloid after being dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), a fatty acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic colloid. For this purpose, the surface active agents illustrated in other parts of the specification can be used.

An amount of the organic solvent having a high boiling point used in the present invention is 10 g per g of the dye providing substance used or less, preferably 5 g per g or less.

In the present invention, it is desirable that a reducing substance is incorporated into the light-sensitive material. Preferred examples of the reducing substances include known reducing agents and the reducing dye providing substances as described above.

The reducing agents which can be used in the present invention include the following compounds.

Hydroquionone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Examples of more preferred reducing agents inclue the following compounds.

3-Pyrazolidone compounds (for example, 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

In the present invention, various dye releasing assistants can be used. The dye releasing assistants include compounds showing a basic property and capable of activating development or compounds having the so-called nucleophilic property. As the dye releasing assistants bases or base precursors can be used.

The base precursors according to the present invention can be used as the dye releasing assistants and may be used together with other base or base precursors.

The dye releasing assistants can be used in any of the light-sensitive materials and dye fixing materials. In the case of incorporating them in light-sensitive materials, it is particularly advantageous to use base precursors.

In the present invention, various development stopping agents can be used for the purpose of obtaining always regular images in spite of variations of processing temperature and processing time.

The term "development stopping agent" is a compound which can rapidly neutralize the base or react with the base after development proceeded properly to decrease a concentration of the base in the layer whereby the development is stopped. Specifically, the development stopping agents include acid precursors capable of releasing an acid by heating and compounds which react with the bases coexistent upon heating to decrease a concentration of the base.

Examples of the former acid precursors include oxime esters as described in Japanese Patent Application Nos. 216928/83 and 48305/84 (corresponding to U.S. Ser. No. 672,643 (November 19, 1984) and U.S. Ser. No. 711,885 (March 14, 1985), respectively), compounds which release an acid by Lossen rearrangement as described in Japanese Patent Application No. 85834/84 (corresponding to U.S. Ser. No. 727,718 (April 26, 1985)), etc. Examples of the latter compounds capable of reacting with the bases by heating include the compounds as described in Japanese Patent Application No. 85836/84 (corresponding to U.S. Ser. No. 727,978 (April 26, 1985)), etc.

It is preferred to use the above described developing stopping agent together with the base precursor since its effect is particularly exhibited. In this case, a molar ratio of the base precursor/the acid precursor is preferably from 1/20 to 20/1, and more preferably from 1/5 to 5/1.

The binder which can be used in the present invention can be employed individually or in a combination thereof. A hydrophilic binder can be used as the binder according to the present invention. The typical hydrophilic binder is a transparent or translucent hydrophilic colloid, examples of which include natural substances, for example, a protein such as gelatin, a gelatin derivative, a cellulose derivative, etc., a polysaccharide such as starch, gum arabic, etc., and synthetic polymeric substances, for example, a water-soluble polyvinyl compound such as polyvinyl pyrrolidone, acrylamide polymer, etc. Another example of the synthetic polymeric substance is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium.trichloroacetate as described in U.S. Pat. No. 3,301,678, bisisothiuroniums including 1,8-(3,6-dioxaoctane)-bis(isothiuronium.trichloroacetate), etc., as described in U.S. Pat. No. 3,669,670, thiol compounds as described in West German Patent Application (OLS) No. 2,162,714, thiazolium compounds such as 2-amino-2-thiazolium.trichloroacetate, 2-amino-5-bromoethyl-2-thiazolium.trichloroacetate, etc., as described in U.S. Pat. No. 4,012,260, and compounds having α-sulfonylacetate as an acid moiety such as bis(2-amino-2-thiazolium)methylene-bis(sulfonylacetate), 2-amino-2-thiazolium phenylsulfonylacetate, etc., as described in U.S. Pat. No. 4,060,420, etc.

In addition, azole thioether and blocked azoline thione compounds as described in Belgian Pat. No. 768,071, 4-aryl-1-carbamoyl-2-tetrazoline-5-thione compounds as described in U.S. Pat. No. 3,893,859 and compounds as described in U.S. Pat. Nos. 3,839,041, 3,844,788 and 3,877,940 are suitably used.

In the present invention, image toning agents can be incorporated, if desired. Effective toning agents are compounds such as 1,2,4-triazoles, 1H-tetrazoles, thiouracils, 1,3,4-thiadiazoles, etc. Examples of preferred toning agents include 5-amino-1,3,4-thiadiazole-2-thiol, 3-mercapto-1,2,4-triazole, bis(dimethylcarbamoyl)disulfide, 6-methylthiouracil, 1-phenyl-2-tetrazoline-5-thione, etc. Particularly effective toning agents are compounds which can form black images.

The concentration of the toning agents incorporated varies according to the kind of heat developable light-sensitive material, processing conditions, images to be required, and other factors, but it is generally in a range of about 0.001 to 0.1 mol per mol of silver in the light-sensitive material.

The above described components composing the heat developable light-sensitive materials of the present invention can be arranged in arbitrarily suitable positions. For example, one or more components can be arranged in one or more film layers in the light-sensitive material, if necessary. In some cases, it is desirable to incorporate the above described reducing agents, image stabilizers and/or other additives in the protective layer in specified amounts (rates). Such a case is sometimes advantageous because movement of additives between layers in the heat developable light-sensitive material can be reduced.

The heat developable light-sensitive materials according to the present invention are effective for forming negative images or positive images. Formation of the negative images or positive images will depend mainly upon selection of the specified light-sensitive silver halide. For example, in order to form direct positive images, it is possible to use an inner image silver halide emulsion as described in U.S. Pat. Nos. 2,592,250, 3,206,313, 3,367,778 and 3,447,927, or a mixture of a surface image silver halide emulsion as described in U.S. Pat. No. 2,996,382 and an inner image silver halide emulsion.

In the present invention, various means for exposure can be used. Latent images are obtained by imagewise exposure of radiant rays containing visible light. Generally, light sources conventionally used, for example, sunlight, a strobo, a flash, a tungsten lamp, a mercury lamp, a halogen lamp such as an iodine lamp, etc., a xenon lamp, a laser, a CRT light source, a plasma light source, a fluorescent tube, a light emitting diode, etc., can be used as a light source.

In the present invention, development is carried out by applying heat to the light-sensitive materials. The heating means may be a hot plate, iron, heat roller, exothermic materials utilizing carbon, titanium white, etc., or analogues thereof.

A support used in the light-sensitive material and a dye fixing material which is used, if necessary, in the present invention is one which resists processing temperature. As the general supports, there are not only glass, paper, metal and analogues thereof but also acetyl cellulose films, cellulose ester films, polyvinyl acetal films, polystyrene films, polycarbonate films, polyethylene terephthalate films and films which are related to these films, and resin materials. Further, paper supports laminated with a polymer such as polyethylene, etc., can be used. Polyesters as described in U.S. Pat. Nos. 3,634,089 and 3,725,070 are suitably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methyloldimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

In the case of using the dye providing substance which releases imagewise a mobile dye according to the present invention, the transfer of dyes from the light-sensitive layer to the dye fixing layer can be carried out using a dye transfer assistant.

The dye transfer assistant suitably used in a process wherein it is supplied from the outside include water and an alkaline aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

A more preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the intermediate layer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

With respect to other compounds capable of being used in the light-sensitive material in the present invention, for example, sulfamide derivatives, cationic compounds having a pyridinium group, etc., surface active agents having a polyethylene oxide chain, antihalation and anti-irradiation dyes, hardeners and mordanting agents, etc., it is possible to use those as described in European Pat. Nos. 76,492 and 66,282, West German Pat. No. 3,315,485, Japanese Patent Application (OPI) Nos. 154445/84 and 152440/84, etc.

Further, as methods of exposure, those cited in the above described patents can be used.

According to the present invention, an image having a high density can be obtained in a short time because the compound represented by the general formula (I) described above is incorporated into the heat developable light-sensitive material as a base precursor. Further, the heat developable light-sensitive material exhibits little change in photographic properties over the course of time and has extremely good preservability.

The present invention will be explained in greater detail with reference to the following examples, but the present invention should not be construed as being limited thereto.

EXAMPLE 1

Method for Preparation of Silver Benzotriazole Emulsion 28 g of gelatin and 13.2 g of benzotriazole were dissolved in 300 ml of water and the solution was maintained at 40° C. with stirring. A solution of 17 g of silver nitrate dissolved in 100 ml of water was added to the above prepared solution over a 2 minute period. The thus-prepared silver benzotriazole emulsion was adjusted in pH, precipitated, and freed of excess salts. It was then adjusted to a pH of 6.30, thereby 400 g of a silver benzotriazole emulsion was obtained.

Method for Preparation of Silver Halide Emulsion

To an aqueous solution of gelatin (prepared by dissolving 20 g of gelatin and 3 g of sodium chloride in 1,000 ml of water and maintained at 75° C.) were added dropwise simultaneously 600 ml of an aqueous solution containing sodium chloride and potassium bromide and an aqueous solution of silver nitrate (prepared by dissolving 0.59 mol of silver nitrate in 600 ml of water) over 40 minutes at an equal addition amount rate while stirring thoroughly. Thus, a monodispersed silver chlorobromide emulsion (bromide content: 50 mol%, crystal form: cubic, average grain size: 0.40 μm) was prepared.

After washing with water and desalting, 5 mg of sodium thiosulfate and 20 mg of 4-hydroxy-6-methyl-1,3,3a,7-tetraazaindene were added and then it was subjected to chemical sensitization at 60° C. The yield of the emulsion was 600 g.

Method for Preparation of Dispersion of Dye Providing Substance in Gelatin

A mixture of 10 g of dye providing substance having the structure shown below, 0.5 g of sodium 2-ethylhexyl sulfosuccinate, as a surface active agent, 5 g of tricresyl phosphate (TCP) and 20 ml of cyclohexanone was dissolved by heating at about 60° C. to prepare a uniform solution. This solution was mixed with 100 g of a 10% aqueous solution of lime-processed gelatin with stirring and the mixture was dispersed by means of a homogenizer at 10,000 rpm for 10 minutes.

Dye Providing Substance

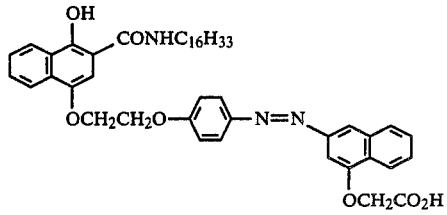

Method for Preparation of Light-Sensitive Coating

| Method for Preparation of Light-Sensitive Coating | |
|---|---|
| (a) Silver benzotriazole emulsion | 5 g |
| (b) Light-sensitive silver halide emulsion | 5 g |
| (c) Dispersion of dye providing substance | 3.5 g |
| (d) Compound (2) according to the present invention | 0.20 g |
| (e) Gelatin (10% aqueous solution) | 5 g |
| (f) Solution containing 0.2 g of 2,6-dichloro-4-aminophenol dissolved in 2 ml of methanol | |
| (g) 10% Aqueous solution of compound having the following formula: | 1 ml |

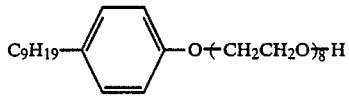

The above components (a) to (g) were mixed, viscosity thereof was adjusted and dissolved by heating and the mixture was coated on a polyethylene terephthalate film having a thickness of 180 μm at a wet layer thickness of 30 μm.

On the thus-formed layer was further coated the solution having the components (a) to (d) described below at a wet layer thickness of 30 μm as a protective layer and dried to prepare Light-Sensitive Material A.

| | |
|---|---|
| (a) 10% Aqueous solution of gelatin | 30 ml |
| (b) Water | 65 ml |
| (c) Compound (2) according to the present invention | 0.8 g |
| (d) 4% Aqueous solution of hardener having the following formula: $CH_2{=}CHSO_2CH_2CONH(CH_2)_2NHCOCH_2SO_2CH{=}CH_2$ | 8 ml |

Further, for comparison, Light-Sensitive Material B was prepared in the same procedure as described for Light-Sensitive Material A except 0.15 g of guanidine trichloroacetate and 0.6 g of guanidine trichloroacetate were used in the emulsion layer and the protective layer in place of Compound (2) according to the present invention, respectively.

A method for preparation of an image receiving material having an image receiving layer is described in the following.

10 g of poly(methyl acrylate-co-N,N,N-trimethyl-N-vinylbenzylammonium chloride) (molar ratio of methyl acrylate to vinylbenzylammonium chloride was 1:1) was dissolved in 200 ml of water and then uniformly mixed with 100 g of 10% aqueous solution of lime-processed gelatin. The resulting mixture was uniformly coated at a wet layer thickness of 90 μm on a paper support laminated with polyethylene with titanium dioxide dispersed therein. The thus-prepared material was dried and then used as an image receiving material.

Light-Sensitive Materials A and B were exposed imagewise, just after the preparation thereof or after the preservation under a temperature condition of 60° C. for 2 days, at 2,000 lux for 5 seconds using a tungsten lamp and then uniformly heated for 20 seconds on a heat block which had been heated at 150° C.

The above described image receiving material was soaked in water and then superimposed on each of the above heated light-sensitive materials in such a manner that their coated layers were in contact with each other. After heating for 6 seconds on a heat block maintained at 80° C., the image receiving material was separated from the light-sensitive material, whereupon a negative magenta color image was obtained in the image receiving material.

The densities of the negative color image were measured using a Macbeth reflection densitometer (RD-519). The results thus obtained are shown in Table 1.

TABLE 1

| Light-Sensitive Material | Just after Preparation | | After Preservation at 60° C. for 2 Days | |
|---|---|---|---|---|
| | Maximum Density | Minimum Density | Maximum Density | Minimum Density |
| A (Present Invention) | 2.01 | 0.21 | 2.05 | 0.30 |
| B (Comparison) | 2.06 | 0.20 | 2.09 | 1.32 |

From the results shown in Table 1, it is understood that the compound according to the present invention can provide images having a high density and a low level of fog not only just after the preparation thereof but also after the preservation and thus the compound has both good development activity and good stability during preservation.

EXAMPLE 2

A method for preparation of a dispersion of dye providing substance in gelatin is described in the following.

A mixture of 5 g of Magenta Dye Providing Substance CI-8 shown above, 0.5 g sodium 2-ethylhexyl sulfosuccinate, as a surface active agent, 10 g of triisononyl phosphate and 30 ml of ethyl acetate was dissolved by heating at about 60° C. to prepare a uniform solution. This solution was mixed with 100 g of a 10% aqueous solution of lime-processed gelatin with stirring and the mixture was dispersed by means of a homogenizer at 10,000 rpm for 10 minutes. The dispersion thus-obtained was designated a dispersion of magenta dye providing substance.

| Method for Preparation of Light-Sensitive Coating | |
|---|---|
| (a) Silver benzotriazole emulsion (same as described in Example 1) | 10 g |
| (b) Light-sensitive silver halide emulsion (same as described in Example 1) | 15 g |
| (c) Dispersion of dye providing substance | 25 g |
| (d) Compound (2) according to the present invention | 1.0 g |
| (e) Benzenesulfonamide (10% methanol solution) | 5 ml |
| (f) Dye having the following formula: | 4 ml |

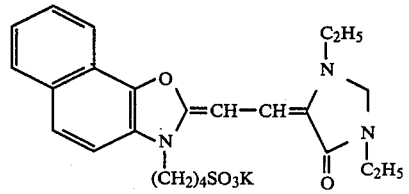

| | |
|---|---|
| (0.04% methanol solution) | |
| (g) 10% Aqueous solution of compound having the following formula: | 5 ml |

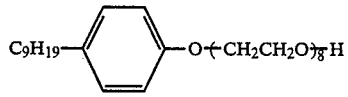

| | |
|---|---|
| (h) Water | 15 ml |

The above components (a) to (h) were mixed, to which were added a viscosity imparting agent and water to make the total volume 100 ml, and the resulting mixture was coated on a polyethylene terephthalate film having a thickness of 180 μm at a wet layer thickness of 50 μm.

On the thus-formed layer was further coated the solution prepared by mixing the components (a) to (d) described below and adding thereto a viscosity imparting agent and water to make the total volume 1 l at a wet layer thickness of 30 μm as a protective layer and dried to prepare Light-Sensitive Material C.

| | |
|---|---|
| (a) 10% Aqueous solution of gelatin | 400 g |
| (b) Water | 240 ml |
| (c) Compound (2) according to the present invention | 16 g |
| (d) 4% Aqueous solution of hardener having the following formula: $CH_2{=}CHSO_2CH_2CONH(CH_2)_2NHCOCH_2SO_2CH{=}CH_2$ | 50 ml |

Further, for comparison, Light-Sensitive Material D was prepared in the same procedure as described for Light-Sensitive Material C except 0.75 g of guanidine trichloroacetate and 12 g of guanidine trichloroacetate were used in the emulsion layer and the protective layer in place of Compound (2) according to the present invention, respectively.

Light-Sensitive Materials C and D were exposed imagewise, just after the preparation thereof or after the preservation under temperature condition of 60° C. for 2 days, at 2,000 lux for 1 second through a green filter using a tungsten lamp and then uniformly heated for 20 seconds on a heat block which had been heated at 150° C.

Each of the heated light-sensitive materials were superimposed on the image receiving material (same as described in Example 1) soaked in water in such a manner that their coated layers were in contact with each other. After heating for 6 seconds on a heat block maintained at 80° C., the image receiving material was separated from the light-sensitive material, whereupon a negative magenta color image was obtained in the image receiving material.

The densities of the negative color image were measured using a Macbeth reflection densitometer (RD-519). The results thus-obtained are shown in Table 2.

TABLE 2

| Light-Sensitive Material | Just after Preparation | | After Preservation at 60° C. for 2 Days | |
|---|---|---|---|---|
| | Maximum Density | Minimum Density | Maximum Density | Minimum Density |
| C (Present Invention) | 2.31 | 0.15 | 2.32 | 0.24 |
| D (Comparison) | 2.40 | 0.18 | 2.41 | 1.55 |

From the results shown in Table 2, it is understood that the compound according to the present invention has both good development activity and good stability during preservation. Further, these effects are remarkably great when a spectrally sensitized silver halide emulsion is employed.

EXAMPLE 3

Light-Sensitive Materials E to K were prepared in the same procedure as described for Light-Sensitive Material C in Example 2 except adding each of the compounds shown in Table 3 below to the emulsion layer and the protective layer in the amounts set forth in the table in place of Compound (2) according to the present invention, respectively. These light-sensitive materials were subjected to the same procedure as described in Example 2. The results thus-obtained are shown in Table 3.

TABLE 3

| Light-Sensitive Material | Compound | Amount Added | Just after Preparation | | After Preservation at 60° C. for 2 Days | |
|---|---|---|---|---|---|---|
| | | | Maximum Density | Minimum Density | Maximum Density | Minimum Density |
| E | (1) | 1.0, 16 | 2.08 | 0.14 | 2.11 | 0.22 |
| F | (4) | 1.0, 16 | 2.19 | 0.16 | 2.22 | 0.26 |
| G | (6) | 1.0, 16 | 2.04 | 0.14 | 2.08 | 0.23 |
| H | (9) | 1.0, 16 | 2.32 | 0.16 | 2.33 | 0.28 |
| I | (11) | 1.0, 16 | 2.35 | 0.15 | 2.35 | 0.35 |
| J | (25) | 1.0, 16 | 2.00 | 0.14 | 2.03 | 0.20 |
| K | (26) | 1.0, 16 | 2.12 | 0.20 | 2.15 | 0.42 |

From the results shown in Table 3, it is understood that the compounds according to the present invention can provide images having a high density and a low level of fog and are excellent in stability during preservation.

EXAMPLE 4

A silver benzotriazole emulsion was prepared in the same manner as described in Example 1.

Also, silver halide emulsions for the fifth layer and the first layer were prepared in the same manner as described in Example 1.

In the following, a method for preparation of a silver halide emulsion for the third layer is described.

To an aqueous solution of gelatin (prepared by dissolving 20 g of gelatin and 3 g of sodium chloride in 1,000 ml of water and maintained at 75° C.) were added dropwise simultaneously 600 ml of an aqueous solution containing sodium chloride and potassium bromide and an aqueous solution of silver nitrate (prepared by dissolving 0.59 mol of silver nitrate in 600 ml of water) over 40 minutes at an equal addition amount rate while stirring thoroughly. Thus, a mono-dispersed silver chlorobromide emulsion (bromide content: 80 mol%, crystal form: cubic, average grain size: 0.35 μm) was prepared.

After washing with water and desalting, 5 mg of sodium thiosulfate and 20 mg of 4-hydroxy-6-methyl-1,3,3a,7-tetraazaindene were added and then it was subjected to chemical sensitization at 60° C. The yield of the emulsion was 600 g.

A method for preparation of a dispersion of dye providing substance in gelatin is described in the following.

A mixture of 5 g of Yellow Dye Providing Substance CI-7 described above, 0.5 g of sodium 2-ethylhexyl sulfosuccinate, as a surface active agent, 10 g of triisononyl phosphate and 30 ml of ethyl acetate was dissolved by heating at about 60° C. to prepare a uniform solution. This solution was mixed with 100 g of a 10% aqueous solution of lime-processed gelatin with stirring and the mixture was dispersed by means of a homogenizer at 10,000 rpm for 10 minutes. The dispersion thus-obtained was designated a dispersion of yellow dye providing substance.

A dispersion of magenta dye providing substance was prepared in the same manner as described above except using Magenta Dye Providing Substance CI-8 described above and using 7.5 g of tricresyl phosphate as an organic solvent having a high boiling point. Further, a dispersion of cyan dye providing substance was prepared in the same manner as described above except using Cyan Dye Providing Substance CI-16 described above.

A color light-sensitive material having the multilayer structure shown in Table 4 below was prepared using the above described components. In Table 4 below the coating amounts are set forth in mg/m$^2$ or mol/m$^2$.

TABLE 4

| | |
|---|---|
| Sixth Layer | Gelatin (1,000 mg/m$^2$), Base precursor*3 (600 mg/m$^2$), Silica*5 (100 mg/m$^2$), Hardener*6 (100 mg/m$^2$) |
| Fifth Layer (green-sensitive emulsion layer) | Silver chlorobromide emulsion (bromide: 50 mol %, silver: 400 mg/m$^2$), Benzenesulfonamide (180 mg/m$^2$), Silver benzotriazole emulsion (silver: 100 mg/m$^2$), Sensitizing Dye D-1 ($1 \times 10^{-6}$ mol/m$^2$), Base precursor*3 (400 mg/m$^2$), Yellow Dye Providing Substance (A) (400 mg/m$^2$), Gelatin (1,000 mg/m$^2$), Solvent having a high boiling point*4 (800 mg/m$^2$), Surface active agent*2 (100 mg/m$^2$) |
| Fourth Layer (intermediate layer) | Gelatin (1,200 mg/m$^2$), Base precursor*3 (600 mg/m$^2$) |
| Third Layer (red-sensitive emulsion layer) | Silver chlorobromide emulsion (bromide: 80 mol %, silver: 300 mg/m$^2$), Benzenesulfonamide (180 mg/m$^2$), Silver benzotriazole emulsion (silver: 100 mg/m$^2$), Sensitizing Dye D-2 ($8 \times 10^{-7}$ mol/m$^2$), Base precursor*3 (350 mg/m$^2$), Magenta Dye Providing Substance (B) (400 mg/m$^2$), Gelatin (1,000 mg/m$^2$), Solvent having a high boiling point*1 (600 mg/m$^2$), Surface active agent*2 (100 mg/m$^2$) |
| Second Layer (intermediate layer) | Gelatin (1,000 mg/m$^2$), Base precursor*3 (600 mg/m$^2$) |
| First Layer (infrared-sensitive emulsion layer) | Silver chlorobromide emulsion (bromide: 50 mol %, silver: 300 mg/m$^2$), Benzenesulfonamide (180 mg/m$^2$), Silver benzotriazole emulsion (silver: 100 mg/m$^2$), Sensitizing Dye D-3 ($1 \times 10^{-8}$ mol/m$^2$), Base precursor*3 (400 mg/m$^2$), Cyan Dye Providing Substance (C) (300 mg/m$^2$), Gelatin (1,000 mg/m$^2$), Solvent having a high boiling point*4 (600 mg/m$^2$), |

TABLE 4-continued

| |
|---|
| Surface active agent (100 mg/m$^2$) |
| Support |

*1Tricresyl phosphate

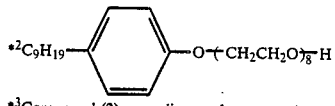

*3Compound (2) according to the present invention
*4$(iso\text{-}C_9H_{19}O)_3P{=}O$
*5Size: 4 μm
*61,2-Bis(vinylsulfonylacetamido)ethane Sensitizing Dye D-1

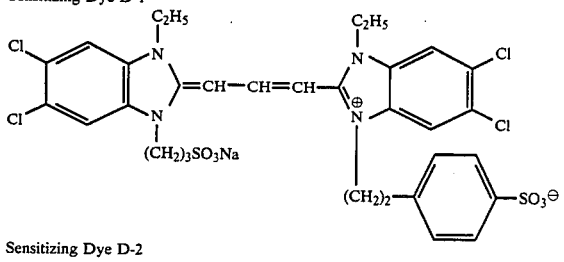

Sensitizing Dye D-2

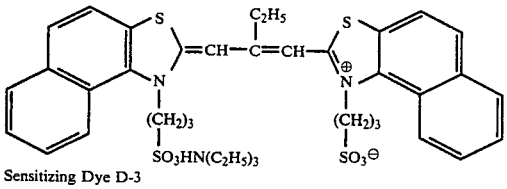

Sensitizing Dye D-3

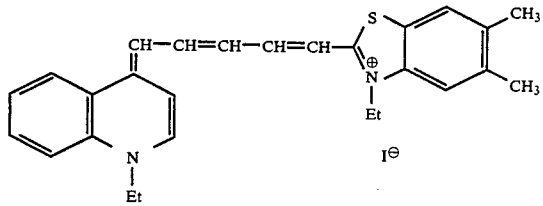

The above described multilayer color light-sensitive material was exposed through a three color separation filter of G, R and IR (G: filter transmitting a band of 500 nm to 600 nm, R: filter transmitting a band of 600 nm to 700 nm, IR: filter transmitting a band of 700 nm or more), the density of which continuously changes for 1 second at 500 lux using a tungsten lamp and then uniformly heated for 30 seconds on a heat block which had been heated at 150° C.

To the coated layer of the image receiving material (same as described in Example 1) was applied 20 ml per m$^2$ water, the image receiving material was then superimposed on the above heated light-sensitive material in such a manner that their coated layers were in contact with each other.

After heating for 6 seconds on a heat block maintained at 80° C., the image receiving material was separated from the light-sensitive material, whereupon yellow, magenta and cyan color images were obtained in the image receiving material corresponding to the three color separation filter of G, R and IR, respectively.

The maximum density (Dmax) and the minimum density (Dmin) of each color were measured using a Macbeth reflection densitometer (RD-519).

Further, the light-sensitive material was preserved at 40° C. for 1 month and then subjected to the same procedure as described above to obtain color images. The maximum densities and the minimum densities of these images were measured in the same manner as described above.

The results thus obtained are shown in Table 5.

TABLE 5

| | Color Image | Maximum Density | Minimum Density |
|---|---|---|---|
| Just after Preparation | Yellow (G) | 2.00 | 0.15 |
| | Magenta (R) | 2.21 | 0.15 |
| | Cyan (IR) | 2.35 | 0.18 |
| After Preservation at 40° C. for 1 Month | Yellow (G) | 2.05 | 0.43 |
| | Magenta (R) | 2.23 | 0.38 |
| | Cyan (IR) | 2.38 | 0.40 |

From the results shown in Table 5, it is understood that the compound according to the present invention can provide images having a high density and a low level of fog and is stable during the preservation.

While the invention has been described in detail and with reference to specific embodiments thereof, it will be apparent to one skilled in the art that various changes and modifications can be made therein without departing from the spirit and scope thereof.

What is claimed is:

1. A heat developable light-sensitive material containing a compound represented by the following general formula (I):

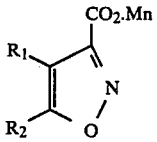

(I)

wherein $R_1$ and $R_2$, which may be the same or different, each represents a hydrogen atom, an alkyl group, a substituted alkyl group, a cycloalkyl group, an aralkyl group, a substituted aralkyl group, an aryl group, a substituted aryl group or a heterocyclic group, or $R_1$ and $R_2$ are bonded to each other to form a 5-membered or 6-membered carbocyclic ring or heterocyclic ring which may be a saturated ring, an unsaturated ring or an aromatic ring, may be condensed and may further have one or more substituents; M represents an alkali metal ion, an alkaline earth metal ion, a transition metal ion, a protonated organic base or a quaternary ammonium ion; and n represents a reciprocal of the positive charge of M.

2. A heat developable light-sensitive material as claimed in claim 1, wherein $R_1$ and $R_2$ each represents a hydrogen atom, a substituted or unsubstituted alkyl group having from 1 to 8 carbon atoms, a cycloalkyl group, a substituted or unsubstituted aryl group having from 6 to 10 carbon atoms or a substituted or unsubstituted aralkyl group having from 7 to 12 carbon atoms.

3. A heat developable light-sensitive material as claimed in claim 1, wherein the ring formed by bonding $R_1$ and $R_2$ is

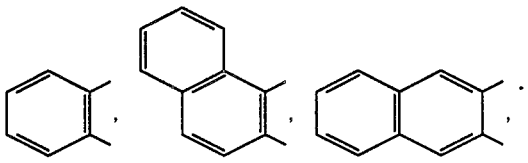

-continued

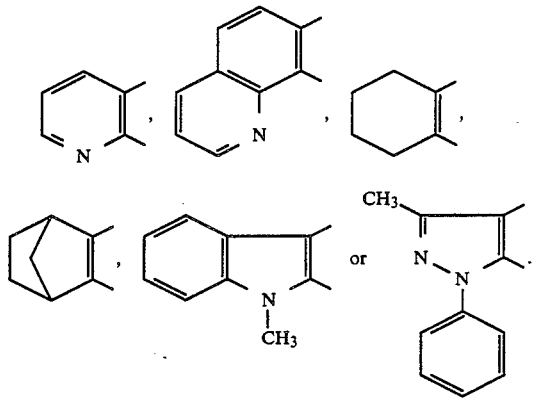

4. A heat developable light-sensitive material as claimed in claim 1, wherein a substituent for the ring formed by bonding $R_1$ and $R_2$ is an alkyl group, an alkoxy group, a halogen atom, a dialkylamino group, a hydroxy group, a carboxy group (including a salt thereof), an aryloxy group, a nitro group, a cyano group, a sulfamoyl group, a carbamoyl group, an acyl group, an acylamino group, an acyloxy group, an alkoxycarbonyl group, a sulfonylamino group, a ureido group, an alkylsulfonyl group, an arylsulfonyl group, an alkylthio group, an arylthio group, an aralkyl group, an aryl group, an alkenyl group, a cycloalkyl group or an amino group.

5. A heat developable light-sensitive material as claimed in claim 1, wherein M represents an ion of Na, K, Cs, Mg, Ca, Ba, Fe, Co, Ni, Cu, Ag, or Hg, a protonated organic base or a quaternary ammonium ion.

6. A heat developable light-sensitive material as claimed in claim 5, wherein M represents a guanidine, a cyclic guanidine, an amidine, an ammonium ion of cyclic amidine, a tetraalkyl ammonium ion, $Na^+$, $K^+$, $Cs^+$ or $Ag^+$.

7. A heat developable light-sensitive material as claimed in claim 1, wherein the compound represented by the general formula (I) is present in an amount of 50% by weight or less based on the coated amount of the dry layer in which it is incorporated.

8. A heat developable light-sensitive material as claimed in claim 7, wherein the compound represented by the general formula (I) is present in an amount of from 0.01% by weight to 40% by weight based on the coating amount of the dry layer in which it is incorporated.

9. A heat developable light-sensitive material as claimed in claim 1, wherein the compound represented by the general formula (I) is present in a light-sensitive layer.

10. A heat developable light-sensitive material as claimed in claim 1, wherein the material contains a light-sensitive silver halide emulsion.

11. A heat developable light-sensitive material as claimed in claim 10, wherein the light-sensitive silver halide emulsion is a spectrally sensitized silver halide emulsion.

12. A heat developable light-sensitive material as claimed in claim 10, wherein the material further contains an organic silver salt oxidizing agent.

13. A heat developable light-sensitive material as claimed in claim 12, wherein the organic silver salt oxidizing agent is a silver salt of an organic compound having a carboxy group, a silver salt of a compound having a mercapto group or a thione group or a silver salt of a compound having an imino group.

14. A heat developable light-sensitive material as claimed in claim 10, wherein the material further contains an image forming substance.

15. A heat developable light-sensitive material as claimed in claim 14, wherein the image forming substance is a coupler capable of forming a color image by bonding to an oxidation product of a developing agent.

16. A heat developable light-sensitive material as claimed in claim 14, wherein the image forming substance is a dye providing substance which releases a mobile dye.

17. A heat developable light-sensitive material as claimed in claim 16, wherein the dye providing substance is a compound represented by the following formula (CI):

$$(\text{Dye—X})_q\text{—Y} \qquad \text{(CI)}$$

wherein Dye represents a dye which becomes mobile when it is released from the molecule of the compound represented by the formula (CI); X represents a simple bond or a connecting group; q represents 1; and Y represents a group which releases Dye in corresponding or countercorresponding to light-sensitive silver salts having a latent image distributed imagewise, the diffusibility of the dye released being different from that of the compound represented by Dye—X—Y.

* * * * *